United States Patent [19]

Wilhelmson

[11] 4,346,363

[45] Aug. 24, 1982

[54] ELECTRONIC CIRCUIT FOR SENSING DEVIATIONS IN PHYSICAL FORCES THEREON

[76] Inventor: Jack Wilhelmson, 244 Colony Ct., Bloomingdale, Ill. 60108

[21] Appl. No.: 972,297

[22] Filed: Dec. 22, 1978

[51] Int. Cl.[3] ..... G08B 3/00

[52] U.S. Cl. ..... 340/27 R; 33/366; 73/178 R; 324/94; 340/384 E; 340/665; 340/870.18

[58] Field of Search ..... 340/27 R, 27 AT, 27 NA, 340/665, 384 E, 177 VA, 177 VC, 207 R, 209; 33/312, 328, 351, 307, 346, 366; 324/92, 94, 65 R, 62 R; 73/178 R, 178 H, 178 T, 801, 802; 244/179, 181

[56] References Cited

U.S. PATENT DOCUMENTS 1,907,402 5/1933 Fedor ..... 340/27 AT
3,089,119 5/1963 Staples ..... 340/27 AT
3,845,657 11/1974 Hall et al. ..... 340/665
3,924,262 12/1975 Melancon ..... 340/27 AT
3,925,751 12/1975 Bateman et al. ..... 340/27 AT

*Primary Examiner*—James J. Groody
*Attorney, Agent, or Firm*—Bianchi & White

[57] ABSTRACT

An electronic sensor circuit is provided which generates predetermined frequencies corresponding to the resultant force vector of the gravitational and inertial forces. There is further provided electronic circuit means for generating an audible response which increases in intensity in correspondence with the magnitude of the deviation of the force vector from a defined datum. In the preferred embodiment an electrolytic transducer is used to sense gravitational and inertial forces and a phase detection circuit is provided to monitor the output and control the input generator for selection of a frequency corresponding to the deviation occurring.

5 Claims, 3 Drawing Figures

ELECTRONIC CIRCUIT FOR SENSING DEVIATIONS IN PHYSICAL FORCES THEREON

BACKGROUND OF THE INVENTION

This invention relates generally to electronic sensors for sensing the direction of a resultant force vector of the gravity and inertial forces, and more particularly concerns audible electronic indicators for assisting pilot coordination of aircraft controls. Presently, aircraft coordination indicators are visual and give poor feedback to a pilot inasmuch as the pilot must direct his visual attention outside of the aircraft in maneuvers near the ground. As a result, poor coordination of the aircraft controls has become a serious problem and too often has resulted in stall/spin accidents. When aircraft controls are perfectly coordinated a stall may be executed without either wing dropping and without the plane entering a spin. Accordingly, the need has developed for a coordination indicator which frees the pilot from watching an instrument in the cockpit.

SUMMARY OF THE INVENTION

Accordingly, it is the primary object of the present invention to provide an audible coordination indicator to replace the visual turn and bank indicators and provide audible feedback to a pilot. It is a further object of the present invention to provide a coordination indicator which produces audible tones of increasing intensity as the coordination decreases and which provides differentiating tones corresponding to the direction of the coordination problem. In summary there is provided an electronic tone generator incorporating an electrolytic transducer for sensing a change in direction or magnitude of the gravity and inertial forces. The change alters circuit parameters of the transducer which is converted to amplitude and phase changes. The phase information is monitored and in response thereto the frequency generated is selected.

While this invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

DESCRIPTION OF THE PREFERRED EMBODIMENTS

Figure 1:
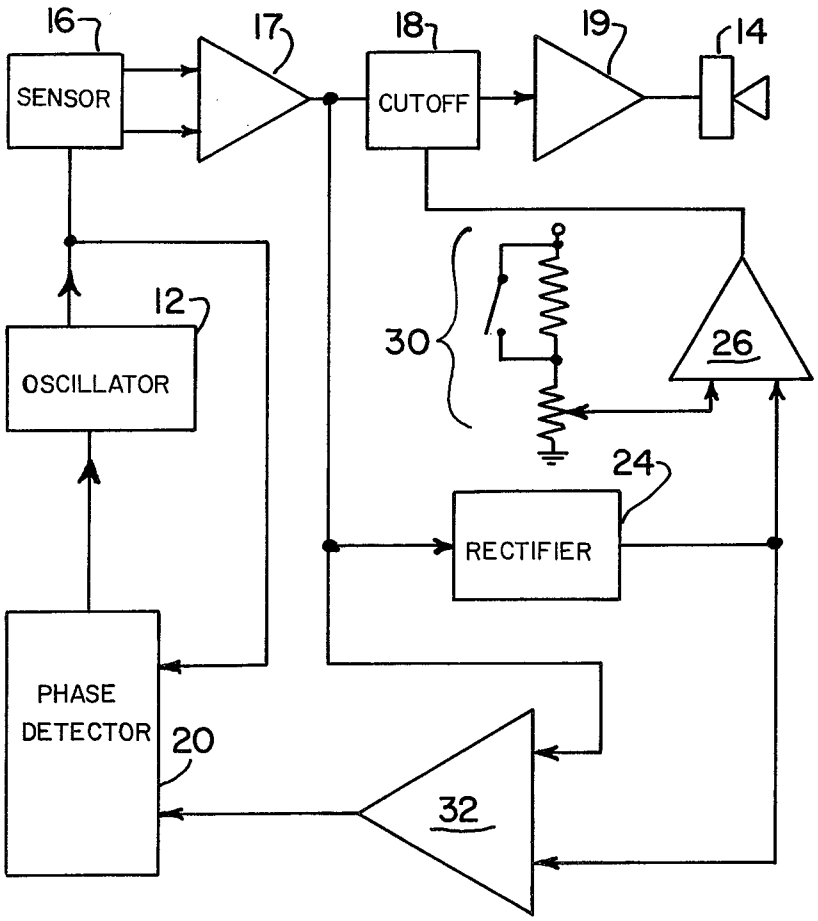
FIG. 1 is a block diagram of the electronic circuit of the present invention.

Turning first to FIG. 1 there is shown a block diagram schematic of the preferred embodiment of the present invention. Particularly, there is provided an audio frequency oscillator 12 for providing tones to the output speaker 14 through the level sensor 16, the differential amplifier 17, the sensitivity cut-off 18, and the power amplifier 19. In the preferred embodiment the oscillator is a dual frequency audio oscillator operating at either 300 or 600 hz. The sensor circuit employs an electrolytic transducer to provide varying conditions in a bridge circuit. This design gives amplitude control and frequency selection through phase detection as more fully described below.

Selection of the appropriate frequency is provided through a phase detection circuit 20 electrically connected to the output of the input generating oscillator and the output of the differential amplifier 17 through the coupling differential amplifier 32 to supply control signals. This phase detection circuit monitors the signal being generated for speaker output and compares it against a reference phase input to the level sensor. For an out-of-phase condition the effective circuit parameters for the oscillator are electrically modified to provide the high tone oscillating circuit. For an in-phase condition the parameters of the oscillator circuit are switched to a low tone condition for the lower oscillating frequency. In the preferred embodiment, the electrolytic transducer in the sensor circuit in conjunction with the differential amplifier 18, will generate an out-of-phase condition when the transducer is subjected to gravitational or inertial force vector in one direction, and will produce an in-phase condition when the transducer is subjected to a change in gravitational or inertial forces in the opposite direction. Consequently, with this closed loop system a tone is selected which corresponds to the direction of the force vector on the transducer.

In a further aspect of the present invention there is provided a rectifier 24 to generate a DC voltage varying with the amplitude of the circuit signal. This rectified voltage is used as one input to a DC comparator 26 and the sensitivity input to the comparator 26 is provided through a variable resistance network 30. The comparator operates a cut off switch 28 and provides the instrument with a selectable deadband to eliminate noise.

Figure 2:
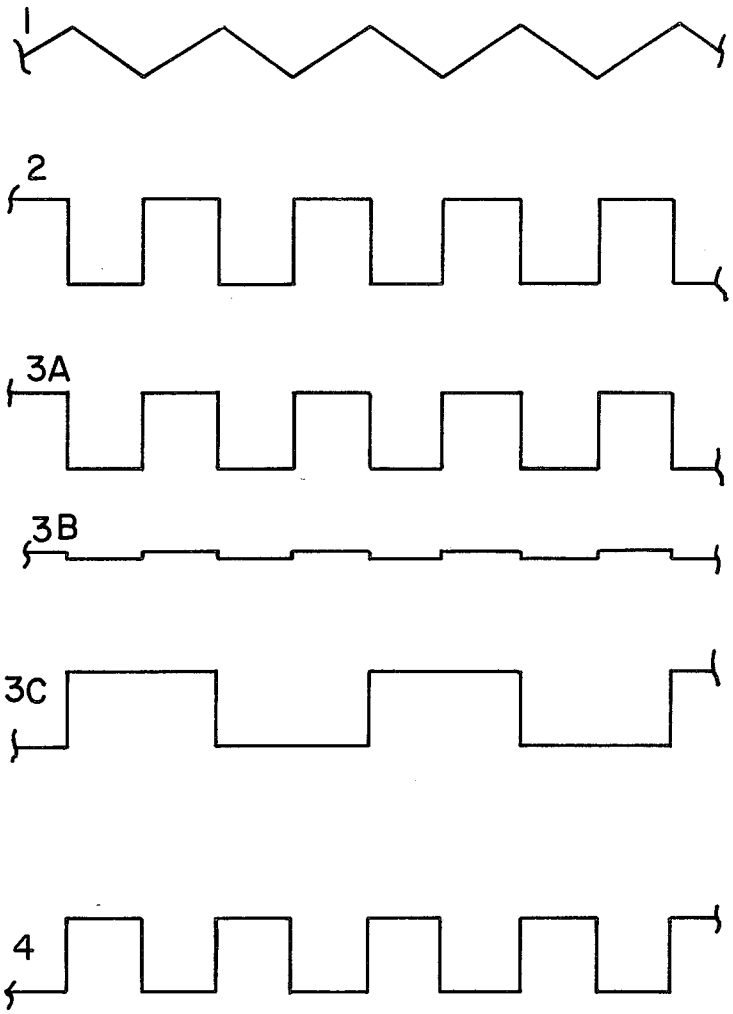
FIG. 2 is a diagram of sample wave forms generated by the preferred embodiment of the present invention.
Figure 3:
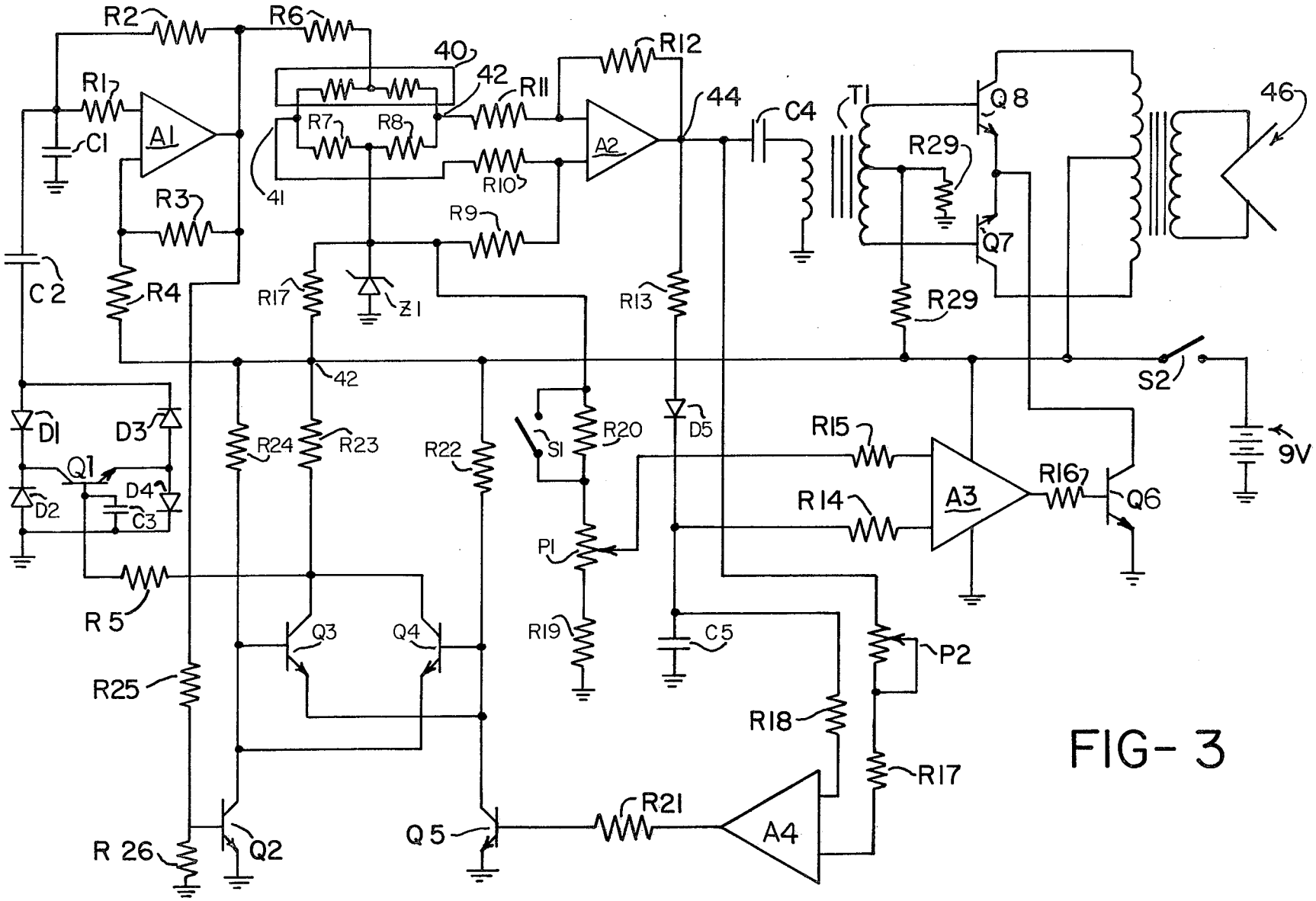
FIG. 3 is a schematic of the preferred embodiment of the electronic circuit of the present invention.

Considering the circuit in more detail, reference should now be made to the schematic in FIG. 3. There is shown a dual frequency oscillator circuit comprising a Norton amplifier A1, resistors R1, R2, R3, R4 and R5, capacitors C1, C2 and C3, diodes D1, D2, D3 and D4, and switching transistor Q1. When operating in its high frequency mode the oscillator uses the charging and discharging of the capacitor C1 to produce a sawtooth waveform 1 (FIG. 2). The Norton amplifier commonly known in the industry as an LM 3900 is arranged in a commonly used oscillating circuit with the input resistor R1 and feedback resistor R2 on a first input and the second input connected to battery potential through resistor R4 and provided with feedback through resistor R3. In this application it is arranged to assume saturated conditions of either high or low output. When the output is high, capacitor C1 is charging and when the input currents are equal the amplifier will switch to a low output. Charging of capacitor C1 continues until the current flowing through the resistor R1 equals the current flowing through resistors R3 and R4. At this point the capacitor will discharge through the resistor R2 until the input currents again equalize, switching takes place, and the cycle is completed.

In low frequency operation of this oscillator transistor Q1 is turned on to effectively place capacitor C2 in parallel with capacitor C1. The frequency output is then reduced correspondingly with the increased capacitance. The operation of the controlling transistor Q1 is described more fully below in conjunction with the phase detection circuit.

Providing the leveling sensitivity is a sensor bridge comprising an electrolytic transducer 40 and bridge resistors R7 and R8. A 4.5 volt reference potential is provided by the Zener diode Z1 in combination with a resistor R27 connected to the 9 volt battery potential 42. The electrolytic transducer is a commercially available device, and in the preferred embodiment represents a medium range transducer of the 7660 series by the Fredricks Company. This transducer is of a generally elongated tube configuration having three electrical terminals arranged in a linear pattern thereon and filled with a conducting fluid. The center terminal is used as an input and the outer terminals as outputs, and when connected in an AC excited bridge circuit the voltage between the output terminals is proportional to the position of the fluid in the tube. Accordingly, the combination of gravitational and inertial forces on the fluid will determine the output.

As the transducer is tilted or the resultant gravitational and inertial forces change, the voltage between the transducer output terminals 41 and 42 increases. Accordingly, the voltage input across resistors R10 and R11 will vary in magnitude and polarity according to the magnitude and direction of the physical forces.

The voltage from the transducer bridge circuit is impressed upon resistors R10 and R11 and the corresponding currents are input to a differential amplifier A2, also an LM 3900 Norton amplifier. This provides a two phase output with a first phase corresponding to a positive current input at the first terminal and a second phase corresponding to a positive current input at the second terminal. As the transducer is tilted from its level position, the voltage difference between its output terminals increases with its polarity corresponding to the direction of tilt. Consequently, one input to the amplifier A2 will be impressed with a positive bias greater than the other input. As a result, the amplifier provides a signal at its output 44 which is proportional to the amount of tilt and the phase of which is determined by the input with the greatest current.

Referring now to FIG. 2 there is shown a representative waveform 3B which approximates the voltage at the output 44 of the differential amplifier A2 for a condition where the transducer is positioned near level. Waveforms 3A and 3C of FIG. 2 approximate the voltage of the output resulting from gross deviations from the level position. In the preferred embodiment this waveform is approximately 6 volts peak-to-peak, and signal 3A represents the high tone response while signal 3B represents the low tone response.

A common audio power amplifier is used to drive a standard speaker and convert the signal at the differential amplifier A2 output to an audible signal. This circuit comprises the coupling capacitor C4 and transformer T1 in combination with the power transistors Q7 and Q8 connected in a customary push/pull configuration.

To provide a sensitivity adjustment on the speaker output, switching transistor Q6 is provided in the emitter circuit of the power transistors. When Q6 is cut off by a low voltage on its base terminal the power transistors are inhibited with a high voltage on their emitter terminals. Accordingly, a sensitivity adjustment is provided through the control of this switching transistor Q6 with the output of a DC comparator A3. This is arranged through the half-way rectification of the sensor output at junction 44 and the input of this rectified signal to the DC comparator. Specifically, there is provided a half-way rectifier comprising a resistor R13, a diode D5 and a capacitor C5 arranged in series and connected between the output of the amplifier A2 and ground. The half-way rectified wave is taken off the positive terminal of C5 and input through load resistor R14 and to a Norton amplifier. The manually adjustable input voltage is provided through the potentiometer P1, sensitivity switch S1 and resistor R19 connected in series to ground from a 4.5 volt battery potential. When the voltage on the capacitor C5 drops below the voltage selected at the other comparator input, the output of the DC comparator will be low. Similarly, a high input voltage at C5 in comparison to the selected voltage will cause the DC comparator to be high and turn the switching transistor Q6 on to thereby enable the power transistors.

Selection of the appropriate audible tone is provided through a phase detection circuit. To provide the input to this phase detection circuit, the output of the operational amp A2 is fed to an overdriven differential amplifier A4 with the half-way rectified signal supplied on the other input. Specifically, the positive input to this differential amplifier is connected to the output of the bridge differential amp at 44 through the series resistance of the resistor R17 and the potentiometer P2. The negative input of this differential amplifier is connected to the positive terminal of the capacitor C5 through the load resistor R18. This differential amplifier is also a Norton amplifier connected in an overdriven mode to provide at its output a full amplitude reproduction of the output signal from the junction 44. This provides a current through the load resistance R21 on the output of the overdriven differential amplifier which is in phase with the junction 44 output signal and adjusted for any DC drift (Waveform 4, FIG. 2).

The phase detection circuit is comprised of the resistance R21, R22, R23, R24, R25 and R26, and switching transistors Q2, Q3, Q4 and Q5, arranged to control switching transistor Q1. For an in-phase condition the collectors of the phase detection switching transistors Q3 and Q4 are high and the tone controlling transistor Q1 will be biased on. Accordingly, the low tone will be generated. For an out-of-phase condition one of the phase detection transistors Q3 or Q4 will be turned on and the junction of their collectors 50 will be low. Consequently, the tone controlling transistor Q1 will be switched off and high tone will be generated.

The operation of the phase detector can be more easily understood by reference to the following table:

TABLE

| Phase | STATUS OF TRANSISTORS | | | | |
|---|---|---|---|---|---|
| Condition | Q2 | Q5 | Q3 | Q4 | Q1 |
| In phase | ON | ON | OFF | OFF | ON |
| In phase | OFF | OFF | OFF | OFF | ON |
| Out-of-phase | ON | OFF | OFF | ON | OFF |
| Out-of-phase | OFF | ON | ON | OFF | OFF |

For an in-phase condition switching transistors Q2 and Q5 will either be both on or both off as the pulse trains reach the transistors. For an out-of-phase condition transistor Q5 will be off while transistor Q2 will be on, and conversely transistor Q5 will be on when transistor Q2 is off. As a result, the base of Q1 will be forward biased only when the collectors of the phase detector transistors Q3 and Q4 are both high. This high state will occur only when both transistors Q3 and Q4 are in their OFF state. Specifically, for an in-phase condition with transistors Q2 and Q5 simultaneously in their ON state, the emitters and bases of transistors Q3 and Q4 will be pulled low and consequently their collectors will be high. With transistors Q2 and Q5 simultaneously OFF, the emitters of transistors Q3 and Q4 will be high and, consequently, they will be in their OFF state and their collectors will be high. For an out-of-phase condition with Q2 on and transistor Q5 off the base of transistor Q3 will be pulled low with its emitter high, while the base of transistor Q4 will be high with its emitter low. This presents a reverse bias on transistor Q3 to hold it in its OFF state, while transistor Q4 will be forward biased and will be in its ON state. With transistor Q5 ON and transistor Q2 OFF a similar pattern occurs and transistor Q3 is turned ON to pull the junction 50 of the collectors low. As a result, the tone controlling transistor Q1 is turned on for in-phase conditions to produce a low tone and turned off for out-of-phase conditions to produce a high tone.

In the preferred embodiment the following components were used.

| | | | |
|---|---|---|---|
| R1 | 3M ohms. | R19 | 10K ohms. |
| R2 | 30K ohms. | R20 | 6.8K ohms. |
| R3 | 10M ohms. | R21 | 100K ohms. |
| R4 | 10M ohms. | R22 | 100K ohms. |
| R5 | 1.1K ohms. | R23 | 10K ohms. |
| R6 | 5.6K ohms. | R24 | 10K ohms. |
| R7 | 1K ohms. | R25 | 100K ohms. |
| R8 | 1K ohms. | R26 | 30K ohms. |
| R9 | 470K ohms. | R27 | 270 ohms. |
| R10 | 33K ohms. | C1 | .04 uf |
| R11 | 33K ohms. | C2 | .068 uf |
| R12 | 470K ohms. | C3 | 15 uf |
| R13 | 10K ohms. | C4 | 10 uf |
| R14 | 470K ohms. | C5 | 10 uf |
| R15 | 470K ohms. | Switching transistors 2N3565 | |
| R16 | 1.5K ohms. | Oscillator diodes 1N914 | |
| R17 | 470K ohms. | | |
| R18 | 470K ohms. | | |

From the foregoing it can be seen that an improved electronic level indicator and aircraft coordination indicator has been disclosed which senses the direction and magnitude of the resultant force vector of the physical forces of gravity and inertia. The circuit uses phase detection means and an electrolytic transducer to select a frequency indicating the direction of the force vector and provides an audible signal corresponding thereto.

What I claim is:

1. An electronic sensor circuit for sensing deviations in direction and magnitude of physical forces thereon comprising:

input means for generating electrical input signals of selected predetermined frequencies;

frequency selecting means electrically coupled to said input means for sensing a deviation in physical forces and selecting in response thereto a predetermined frequency corresponding to the direction of the deviation; and amplitude control means electrically coupled to said frequency selecting means for receiving said selected frequencies and providing an amplitude controlled output of said selected frequencies corresponding to the magnitude of the deviation of the physical forces.

2. The sensor circuit of claim 1 wherein said frequency selecting means comprises:

an electrolytic transducer having an input and multiple outputs thereon, and wherein said transducer input is electrically coupled to said input generating means, and said transducer outputs provide electrical signals corresponding to the direction of the physical forces on said transducer;

phase shift means electrically coupled to said transducer outputs for providing a phase shifted output signal in response to said transducer outputs corresponding to the direction of the physical forces thereon; and a phase detection circuit electrically coupled to said phase shifted output signal for detecting the phase of said phase shifted output signal and providing in response thereto a controlling signal to said input generating means for causing the selected frequency to be generated.

3. The sensor circuit of claim 2 wherein said input generating means comprises a Norton amplifier electrically connected to provide an oscillating electrical signal output the frequency of which is determined by the charging and discharging of a selectable capacitance controlled by said phase detection circuit.

4. The sensor circuit of claim 3 wherein said phase detection circuit comprises: a first, second, third, and fourth switching transistors; wherein the collectors of said first and second transistors are electrically connected; the collector of said third transistor is electrically connected to the base of said first transistor and the emitter of said second transistor, and the collector of said fourth transistor is electrically connected to the base of said second transistor and the emitter of said first transistor, wherein the collector junction of said first and second transistors provides said controlling signal, and wherein the base input to said third and fourth transistors represent a reference AC signal and said phase shifted output signal respectively.

5. The electronic sensor of claims 1, 2, 3 or 4 further comprising audible conversion means coupled to the output of said amplitude control means for providing an audible output corresponding in tone and intensity to the output of the amplitude control means.

* * * * *